US007926630B2

(12) United States Patent
Baldreich

(10) Patent No.: US 7,926,630 B2
(45) Date of Patent: Apr. 19, 2011

(54) DAMPING DEVICE INCLUDING MOUNTING PLATE FOR HOLDING A LINEAR DAMPER

(75) Inventor: Armin Baldreich, Lauterach (AT)

(73) Assignee: Julius Blum GmbH, Höchst (AT)

( * ) Notice: Subject to any disclaimer, the term of this patent is extended or adjusted under 35 U.S.C. 154(b) by 53 days.

(21) Appl. No.: 10/983,601

(22) Filed: Nov. 9, 2004

(65) Prior Publication Data

US 2005/0098394 A1 May 12, 2005

(30) Foreign Application Priority Data

Nov. 10, 2003 (AT) ..... GM 785/2003

(51) Int. Cl.
*F16D 65/14* (2006.01)
*F16D 9/34* (2006.01)

(52) U.S. Cl. ..... 188/205 R; 188/322.12; 248/74.2

(58) Field of Classification Search ..... 188/322.12, 188/322.16, 205 R, 233.3, 266; 248/50–53, 248/55, 56, 66, 74.2; 312/319.1, 334.1, 334.8
See application file for complete search history.

(56) References Cited

U.S. PATENT DOCUMENTS

| | | | | |
|---|---|---|---|---|
| 4,010,572 | A * | 3/1977 | Peterson | 49/386 |
| 4,372,429 | A * | 2/1983 | Marx | 188/322.12 |
| 4,471,526 | A * | 9/1984 | Zaltsberg | 29/745 |
| 4,872,633 | A * | 10/1989 | Sullivan | 248/340 |
| 5,513,730 | A * | 5/1996 | Petrovich et al. | 188/271 |
| 5,873,688 | A * | 2/1999 | Wheatley | 410/106 |
| 5,896,720 | A * | 4/1999 | Bond | 52/698 |
| 6,142,919 | A * | 11/2000 | Jorgensen | 482/121 |
| 6,622,976 | B1 * | 9/2003 | Ianello | 248/73 |
| 6,736,471 | B2 * | 5/2004 | Lin | 312/333 |
| 2001/0008037 | A1 * | 7/2001 | Brustle | 16/71 |
| 2003/0067257 | A1 | 4/2003 | Gasser | |

FOREIGN PATENT DOCUMENTS

| | | | |
|---|---|---|---|
| DE | 91 14 787 | U1 | 4/1992 |
| EP | 1076145 | A1 | 2/2001 |
| EP | 1120066 | A2 | 8/2001 |
| EP | 1348354 | A1 | 10/2003 |
| FR | 548323 | | 1/1923 |
| JP | 59186825 | A * | 10/1984 |

OTHER PUBLICATIONS

English translation of FR'323.*

* cited by examiner

*Primary Examiner* — Melody M Burch
(74) *Attorney, Agent, or Firm* — Wenderoth, Lind & Ponack, L.L.P.

(57) ABSTRACT

A mounting plate is provided for a linear damper with a cylinder, a piston, and a piston rod. The cylinder of the linear damper is held between holding jaws of the mounting plate. The holding jaws of the mounting plate form a movable bearing in which the cylinder is axially displaceable. A stop is provided, which is made at least partially of a material with rubber elastic properties, which strikes against the cylinder of the linear damper during damping.

30 Claims, 8 Drawing Sheets

DAMPING DEVICE INCLUDING MOUNTING PLATE FOR HOLDING A LINEAR DAMPER

BACKGROUND OF THE INVENTION

The invention relates to a mounting plate for a linear damper having a cylinder, a piston and a piston rod, and the cylinder of the linear damper is held between holding jaws of the mounting plate. Further, the invention relates to a damper arrangement and a pull-out guide for drawers or similar with a drawer rail fitted to the drawer and a mounting rail fitted to a body of furniture, whereby a linear damper with a cylinder having a movable piston therein is arranged on one of the rails, and the damper brakes the drawer rail.

The object of the invention is to achieve optimal anchoring of the linear damper on one of the rails of the pull-out guide fitting, and to allow the simple exchange of a defective linear damper.

SUMMARY OF THE INVENTION

According to the invention, this object is achieved in that the holding jaws of the mounting plate form a loose bearing in which the cylinder is axially displaceable.

Advantageously, the mounting plate, which is rectangular in top view, may have lateral grooves and a frontally projecting hook, and preferably the mounting rail has a ridge with a longitudinal slot. The mounting plate is inserted in the longitudinal slot in such a way that the lateral edges of the slot project into the lateral grooves of the mounting plate and the hook on the front end of the mounting plate snaps in a recess of the ridge, the recess being provided on the front face of the longitudinal slot and at a distance therefrom.

With the mounting plate according to the invention, the linear damper can simply be pressed between the holding jaws and is thus immediately functional. No tools are needed to press in the linear damper or to dismantle the linear damper.

The cylinder of the linear damper is held resiliently or spring-clamped by the holding jaws. It is held captive in the mounting plate, but can be axially displaced in the mounting plate during the damping process.

A further object of the invention is to improve the damping effect.

This object is achieved in a damper arrangement for movable parts of furniture including a damper with a movable damper part and a stop which is movable relative to the damper, and the stop impacts on the moving damper part during the damping process and thus effects the damping. This damper arrangement is particularly for use with a mounting plate as described above because the stop consists at least partially of a material with rubber elastic properties.

BRIEF DESCRIPTION OF THE DRAWINGS

In the following, an embodiment of the invention will be described in more detail with reference to the accompanying drawings, in which.

DETAILED DESCRIPTION OF THE INVENTION

Figure 1:
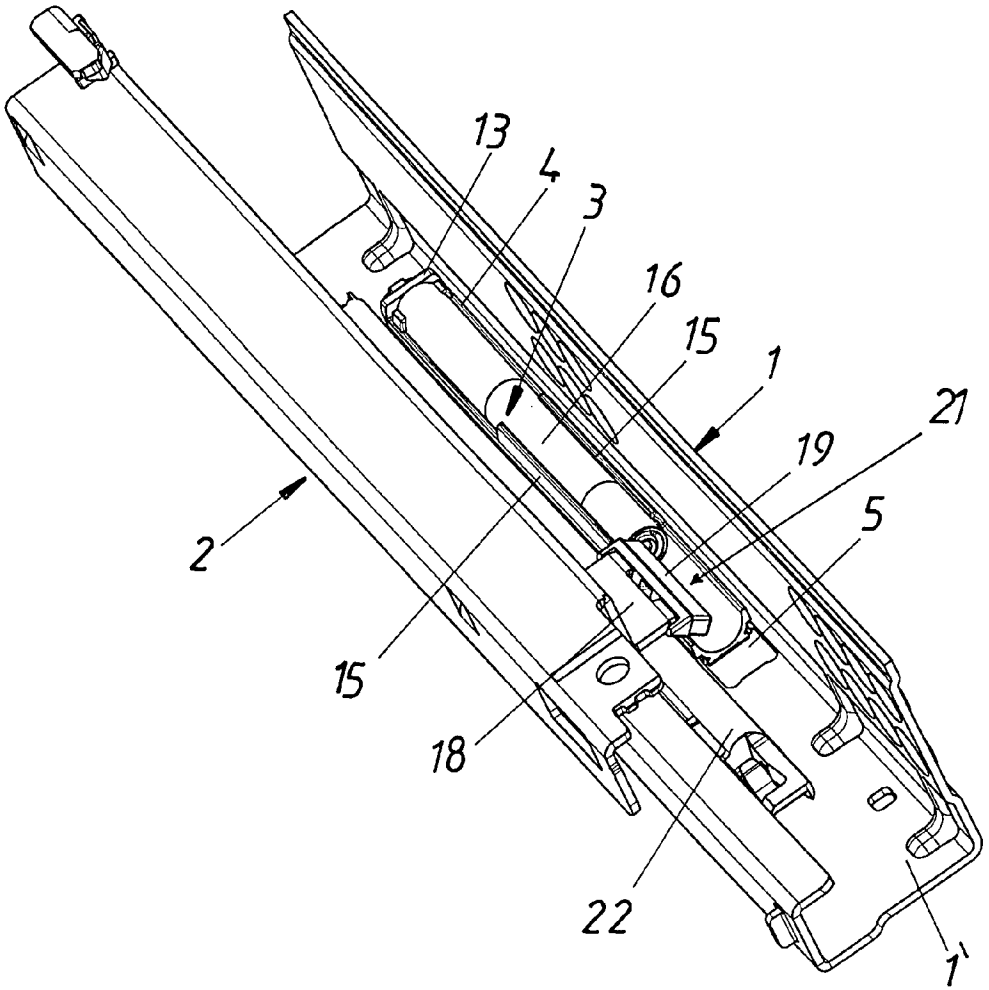
FIG. 1 is a diagram of a pull-out device according to the invention.

There is a pull-out guide consisting of a mounting rail 1 and a drawer rail 2 on each side of the drawer. The load of the drawer rail 2 on the mounting rail 1 is transferred via rollers which are mounted on the rails 1, 2 or in carriages, which run differentially between the rails 1, 2. A linear damper 3 can be provided on both sides of the drawer or on one side only. It is an essential advantage of the invention that one of the rails 1, 2 (in this case, the mounting rail 1) can be quickly and easily fitted with a linear damper 3. The linear damper 3 is accepted into a mounting plate 4 which is anchored in the horizontal ridge 1' of the mounting rail 1. The horizontal ridge 1' has a longitudinal slot 5, in which the mounting plate 4 is inserted. At one front (first) end of the longitudinal slot 5 there is a slot-shaped recess 6, which is aligned at a right angle to the longitudinal slot 5.

At the second end opposite the recess 6, the longitudinal slot 5 is provided with an extension 7.

The mounting plate 4 has lateral ridges 8 at one end (a second end) which delimit grooves 9. At the other (first) end, the mounting plate 4 is provided with a hook 10. The mounting plate 4 with the hook 10 is made from plastic, and the hook 10 is designed to be elastic.

To fit the mounting plate 4 on the mounting rail 1, the mounting plate 4 is inserted in the slot 5 in such a way that it lies with its support edges 11 on the slot edges 12, and so that the ridges 8 are disposed in the area of the extension 7. After that, the mounting plate 4 is displaced until the hook 10 snaps into the recess 6. In this position, the edges 12 of the longitudinal slot 5 engage the grooves 9 on the opposite (second) end of the mounting plate 4.

The mounting plate 4 has a trough-shaped area (trough-shaped section) 14 and a front wall 13. In the middle of the trough-shaped area, the mounting plate 4 is provided with two holding jaws 15, which in the embodiment shown are moulded out of plastic in a single piece with the mounting plate 4. The linear damper 3 is inserted into the trough-shaped area 14 of the mounting plate 4 in such a way that it is clipped, with its cylinder 16, between the holding jaws 15. The trough-shaped area 14 extends over 160° to 180° of the perimeter of the cylinder, and extends along substantially the entire length of the linear damper 3 as illustrated in FIGS. 2 and 7 through 9. The piston rod 17 thereby strikes against the front plate 13 of the mounting plate 4.

Figure 2:
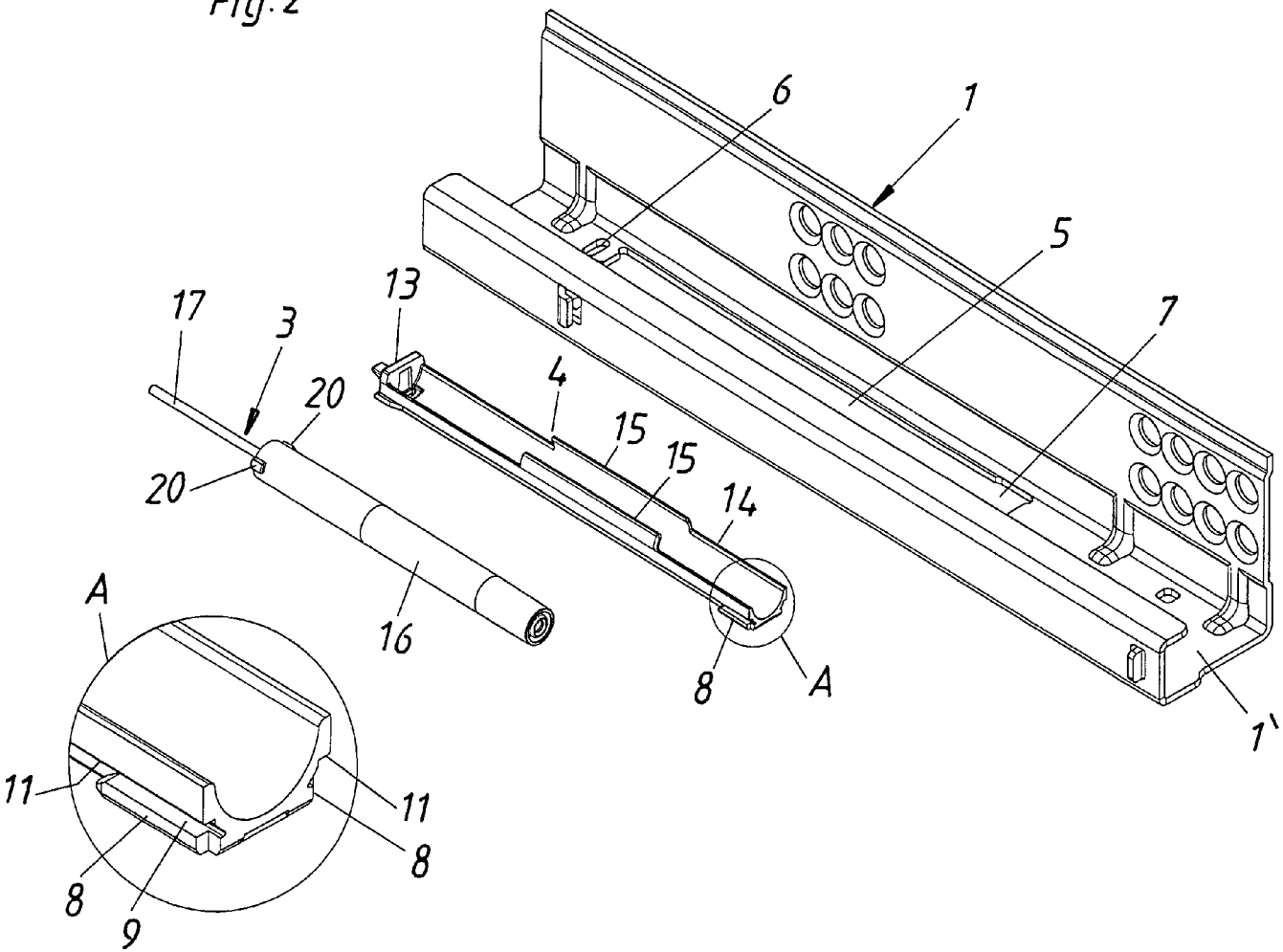
FIG. 2 is a diagram of a mounting rail of a mounting plate according to the invention, and of a linear damper, whereby the parts are drawn pulled apart.
Figure 4:
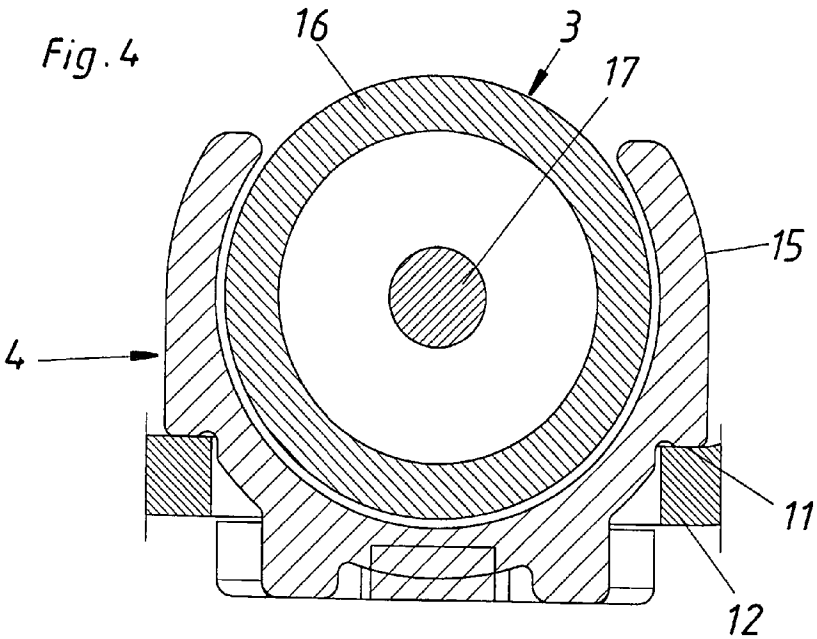
FIG. 4 is the sectional view along line B-B of FIG. 3.
Figure 3:
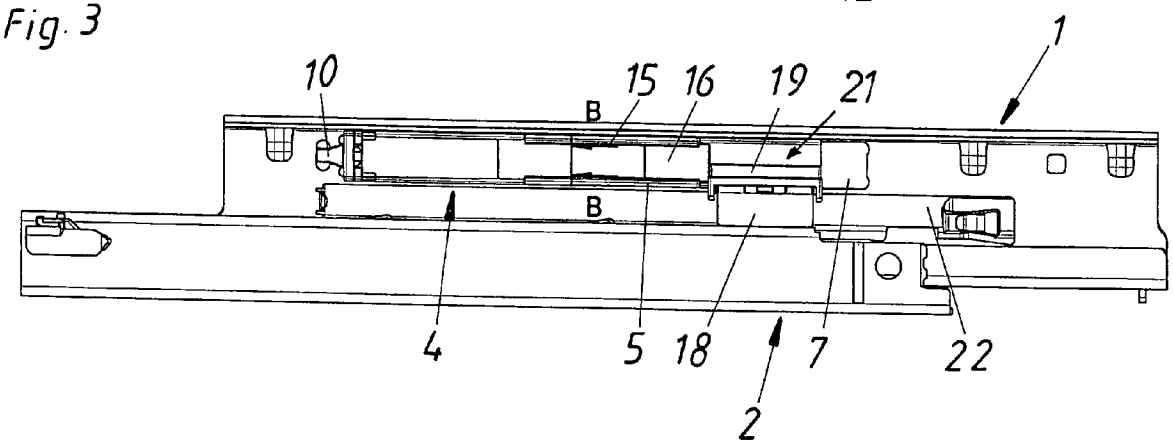
FIG. 3 is a top view of a pull-out device according to the invention.
Figure 5:
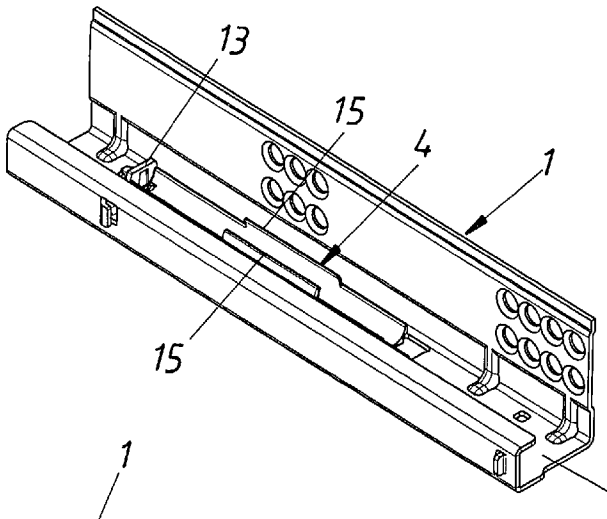
FIG. 5 is a diagram of a mounting rail and a mounting plate mounted thereon.
Figure 6:
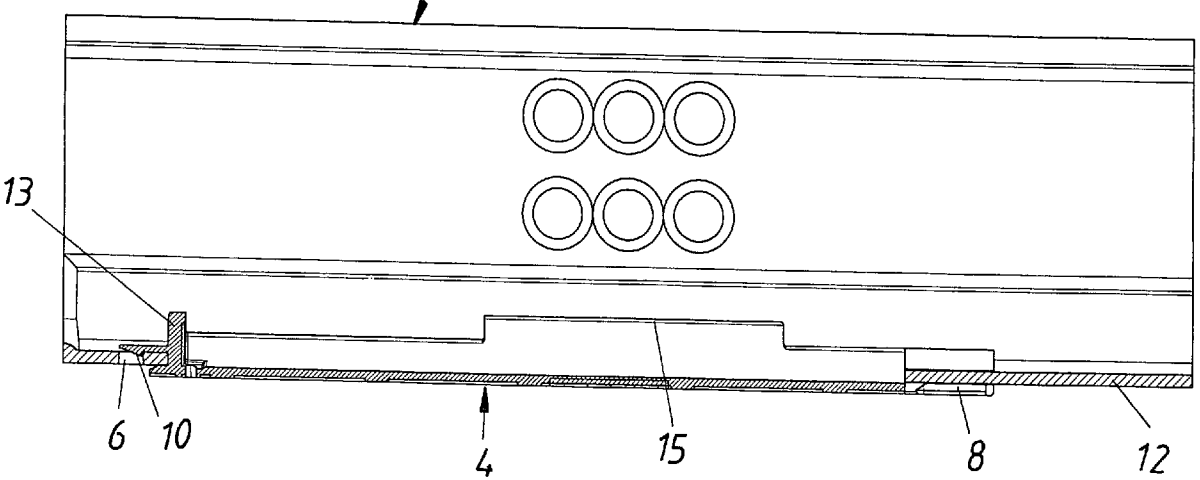
FIG. 6 is a vertically-aligned longitudinal sectional view through the mounting rail in the area of the mounting plate.
Figure 7:
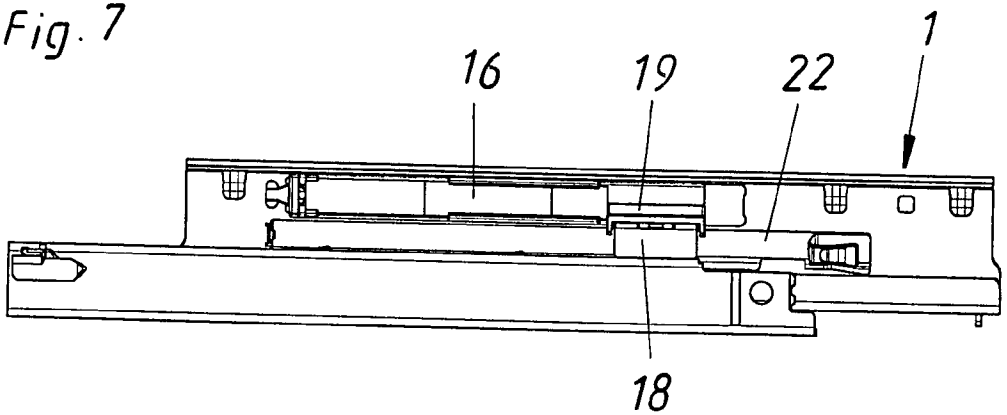
FIG. 7 is a top view of a pull-out device according to the invention in the pushed-in position.
Figure 8:
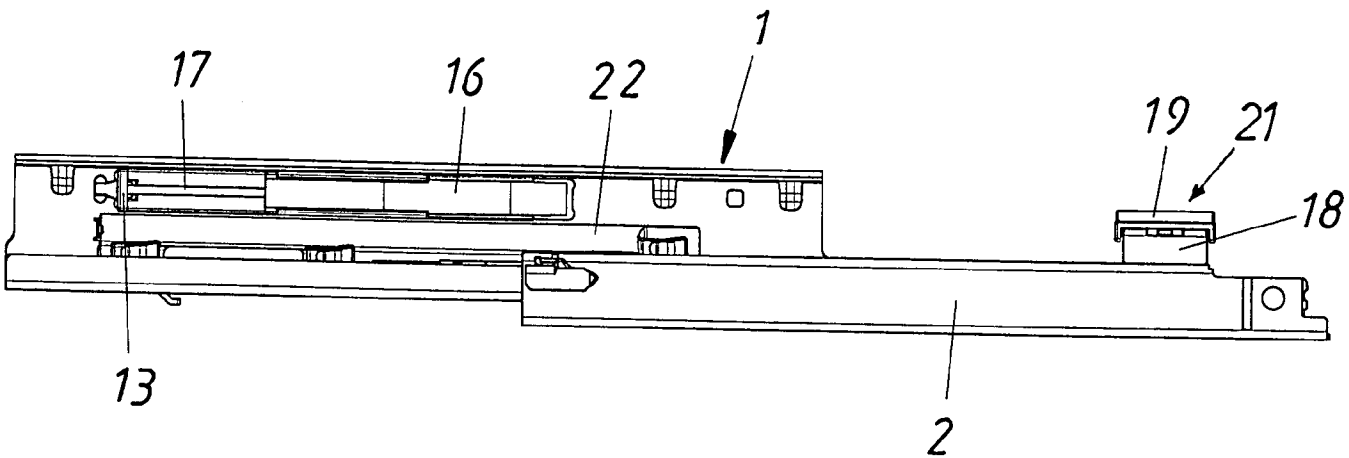
FIG. 8 is a top view of a pull-out device according to the invention in the pulled-out position.

The holding jaws 15 form a loose bearing for the cylinder 16 of the linear damper 3 (i.e., although the cylinder 16 is anchored on the mounting plate 4, it can be displaced longitudinally). The holding jaws are shaped to encompass more than 180° of the perimeter of the cylinder; preferably between 190° and 260° of the perimeter; and more preferably between 200° and 230°. As shown in FIGS. 2 and 4, the holding jaws 15 extend from the edges of the mounting plate 4 so that the inside surface of the trough-shaped area 14 and jaws 15 has a uniform radius (see FIG. 4) to allow the cylinder 16 to smoothly move in an axial direction along mounting plate 4.

Figure 14:
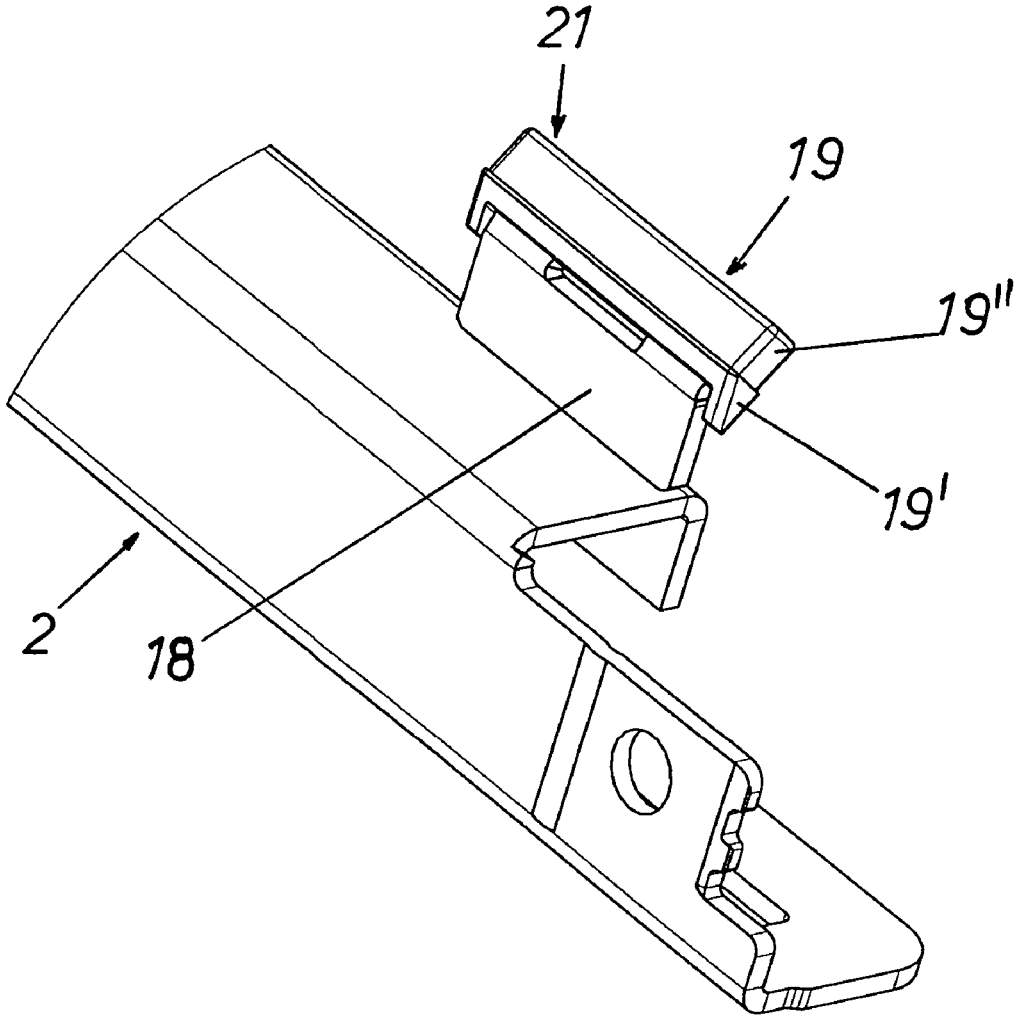
FIG. 14 is a diagram of the frontal area of the drawer rail with the stop.

As shown in FIG. 14, the pull-out (drawer) rail 2 has a laterally-projecting tab 18 which is provided with a cap 19 made of plastic. The tab 18 and the cap 19 form a stop 21 for the linear damper 3. The cap 19 is designed as a two-component moulded part with a harder area 19', which is slid directly onto the tab 18, and a softer area 19" having rubber elastic properties, on which the cylinder 16 of the linear damper 3 impacts laterally when the drawer closes.

Figure 9A:
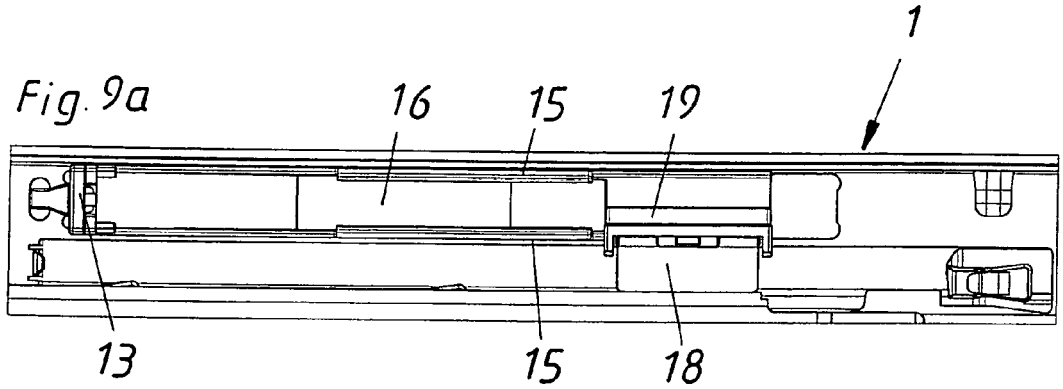
FIG. 9*a* is a schematically contrasted top view of a pull-out device according to the invention at the end of the damping path.
Figure 9B:
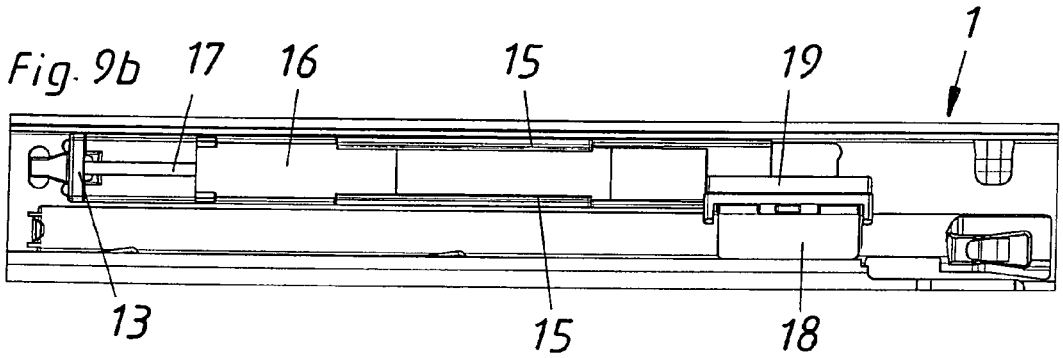
FIG. 9*b*, 9*c* are top views of the damper and the stop on the drawer rail during damping.
Figure 9C:
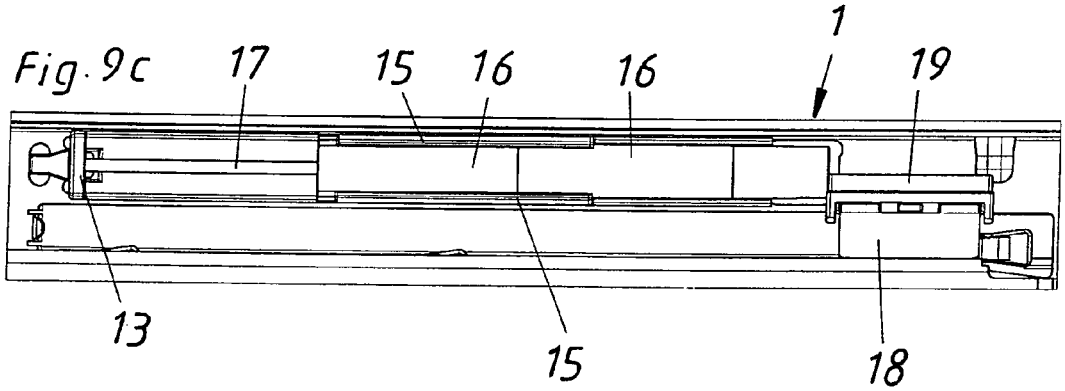
Figure 9D:
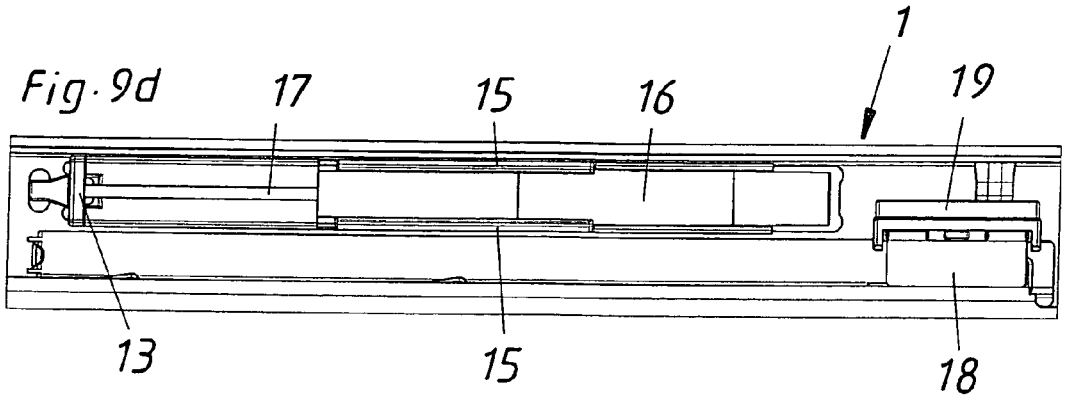
FIG. 9*d* is a top view of the damper and the stop on the drawer, with the damper shown in the ready position.
Figure 10:
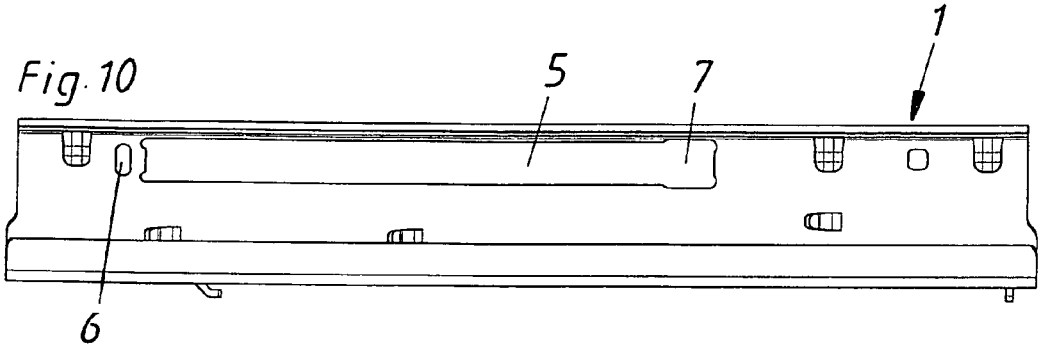
FIG. 10 is a top view of the mounting rail without a mounting plate.
Figure 11:
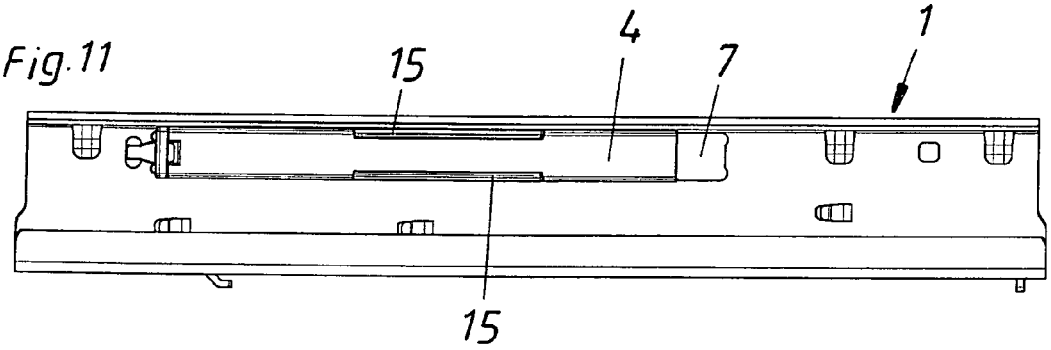
FIG. 11 is a top view of the mounting rail with mounting plate fitted.
Figure 12:
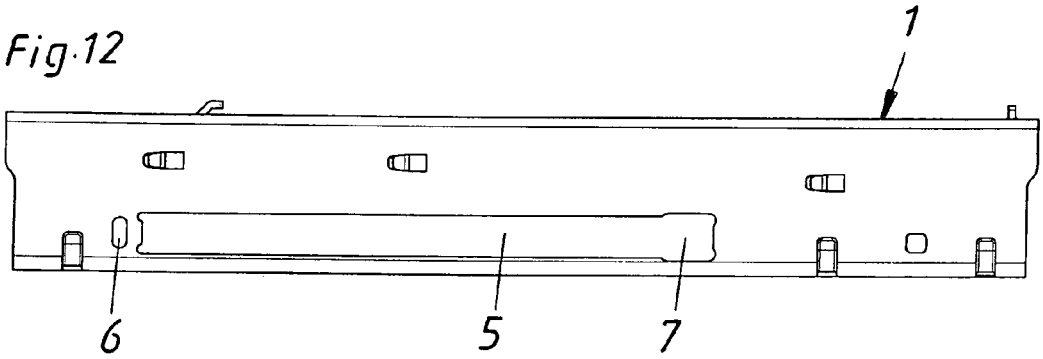
FIG. 12 is a bottom view of the mounting rail without a mounting plate.
Figure 13:
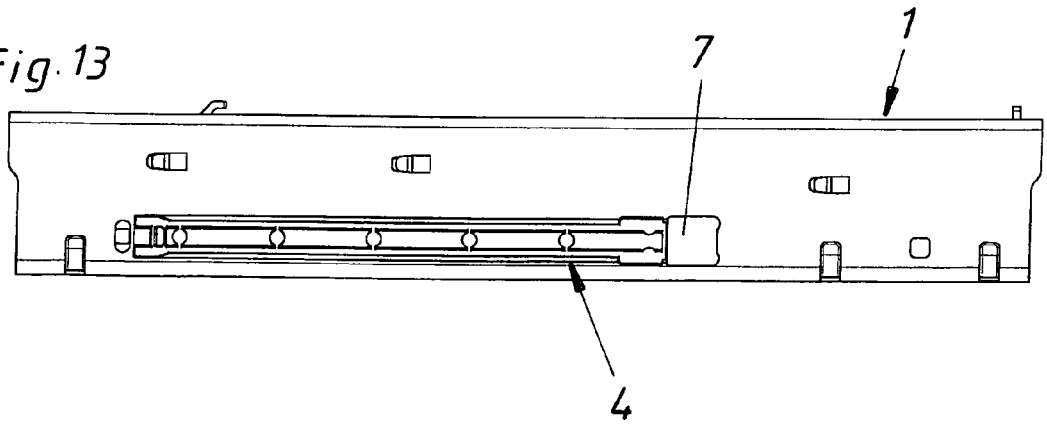
FIG. 13 is a bottom view of the mounting rail with the mounting plate fitted.

When the pull-out rail 2 is brought into the rear closed position, the stop 21 with the cap 19 impacts at the door side on the cylinder 16 of the linear damper 3, and the cylinder 16 is pushed backwards (see FIG. 9A). The piston rod 17 then rests upon the front wall 13 and thus there is a relative movement between the piston, which is inside the cylinder 16, and the cylinder 16. The linear damper 3 is preferably designed as a fluid damper. The fluid can be either a gas or air or a liquid.

In the cylinder 16, there is a return spring.

If the drawer is opened, i.e. the drawer rail 2 is drawn to the right according to FIG. 1, then the return spring forces the cylinder 16 into the initial position, until its lateral stops 20 abut against the leading edges of the holding jaws 15. The linear damper 3 is then back in the ready position (see FIGS. 9B-9D).

Next to the mounting plate 4 and the linear damper 3, there is disposed a retraction guide 22 which draws the drawer rail 2 into the final closed position. This type of retraction device is described, for example, in the German utility model DE 91 14 787 U by the applicant. The spring of the retraction device must in that case be strong enough to move against the resistance of the return spring and of the damping fluid when the cylinder 16 closes.

The invention claimed is:

1. A pull-out guide assembly for a drawer, comprising:

a drawer rail to be fitted to the drawer;

a mounting rail to be fitted to a body of furniture; and a damping device including:

a linear fluid damper including a cylinder, a piston, and a piston rod; and a mounting plate having a trough-shaped section for receiving said linear fluid damper therein, and a front plate at an end of said trough-shaped section, said trough-shaped section having a length greater than a length of said cylinder, said trough-shaped section of said mounting plate comprising holding jaws for holding said cylinder of said linear fluid damper therebetween such that said piston rod of said linear fluid damper abuts against said front plate, said holding jaws being arranged to define a bearing for supporting said cylinder so that said cylinder moves axially within said trough-shaped section and through said holding jaws during each damping stroke of a damping operation of said linear fluid damper;

wherein said linear fluid damper is mounted on one of said drawer rail and said mounting rail via said mounting plate so that said linear fluid damper dampens movement of said drawer rail; and wherein said trough-shaped section is configured to extend substantially an entire length of said mounting plate.

2. The pull-out guide assembly of claim 1, wherein said mounting plate is rectangular in top view, and has a hook projecting from a first end of said mounting plate and has lateral grooves.

3. The pull-out guide assembly of claim 2, wherein said grooves are formed at a second end of said mounting plate opposite said first end.

4. The pull-out guide assembly of claim 1, wherein said holding jaws are resilient so as to hold said cylinder of said linear fluid damper in a resilient or spring-clamped manner.

5. The pull-out guide assembly of claim 1, wherein said holding jaws are shaped and arranged to define stops for limiting an axial displacement of said cylinder through said holding jaws.

6. The pull-out guide assembly of claim 1, wherein said holding jaws are shaped to encompass more than 180° of a perimeter of said cylinder.

7. The pull-out guide assembly of claim 1, wherein said holding jaws are shaped to encompass between 190° and 260° of a perimeter of said cylinder.

8. The pull-out guide assembly of claim 1, wherein said holding jaws encompass between 200° and 230° of a perimeter of said cylinder.

9. The pull-out guide assembly of claim 1, wherein said trough-shaped section extends over 160° to 180° of said perimeter of said cylinder.

10. The pull-out guide assembly of claim 1, further comprising a stop operable to travel relative to said linear fluid damper, said stop being shaped and arranged to impact upon a movable damper part of said linear fluid damper during a damping operation so as to effect the damping operation, said stop being at least partially made of a material with rubber elastic properties.

11. The pull-out guide assembly of claim 10, wherein said stop is at least partially made of an elastomer.

12. The pull-out guide assembly of claim 10, wherein said stop comprises a metallic tab and a cap placed on said tab, said cap being at least partially made of a material with rubber elastic properties.

13. The pull-out guide assembly of claim 12, wherein said cap is made of synthetic material.

14. The pull-out guide assembly of claim 12, wherein said cap is made of an elastomer.

15. The pull-out guide assembly of claim 12, wherein said cap comprises a two-component moulded part including a hard carrier material and a soft striking material.

16. The pull-out guide assembly of claim 10, wherein said stop includes at least one part comprising a two-component moulded part including a hard carrier material and a soft striking material.

17. The pull-out guide assembly of claim 10, wherein said movable damper part is operable to strike laterally against said stop during the damping operation.

18. The pull-out guide assembly of claim 10, wherein said movable damping part comprises said cylinder to be impacted upon by said stop during the damping operation.

19. The pull-out guide assembly of claim 10, wherein said linear fluid damper and said stop are located on rails of a pull-out guide rail for a drawer.

20. The pull-out guide assembly of claim 10, wherein said linear fluid damper is disposed on said mounting rail, and said stop is disposed on said drawer rail.

21. The pull-out guide assembly of claim 1, wherein said linear fluid damper is mounted on said mounting rail by said mounting plate.

22. The pull-out guide assembly of claim 1, wherein said one of said drawer rail and said mounting rail on which said mounting plate is mounted has a ridge with a longitudinal slot, said mounting plate being inserted in said longitudinal slot such that lateral edges of said longitudinal slot project into lateral grooves of said mounting plate, said mounting plate having a hook at a front end thereof, said hook being shaped to snap into a recess in said ridge, said recess being spaced apart from said front end of said longitudinal slot.

23. The pull-out guide assembly of claim 22, wherein said ridge with said longitudinal slot is anchored on said mounting rail.

24. The pull-out guide assembly of claim 22, wherein the other of said drawer rail and said mounting rail on which said mounting plate is not mounted has a stop shaped to strike against said cylinder of said linear fluid damper.

25. The pull-out guide assembly of claim 24, wherein said drawer rail has said stop.

26. The pull-out guide assembly of claim 1, wherein said cylinder of said linear fluid damper has two lateral stops arranged so that, when said linear fluid damper is in a ready position, said lateral stops abut against front edges of said holding jaws of said mounting plate.

27. The pull-out guide assembly of claim 1, further comprising a retraction device mounted to said drawer rail.

28. A pull-out guide assembly for a drawer, comprising:

a drawer rail to be fitted to the drawer;

a mounting rail to be fitted to a body of furniture; and a damping device including:

a linear fluid damper including a cylinder, a piston, and a piston rod; and a mounting plate having a trough-shaped section for receiving said linear fluid damper therein, and a front plate at an end of said trough-shaped section, said trough-shaped section having a length greater than a length of said cylinder, said trough-shaped section of said mounting plate comprising holding jaws for holding said cylinder of said linear fluid damper therebetween such that said piston rod of said linear fluid damper abuts against said front plate, said holding jaws being arranged to define a bearing for supporting said cylinder so that said cylinder moves axially within said trough-shaped section and through said holding jaws during each damping stroke of a damping operation of said linear fluid damper;

wherein said linear fluid damper is mounted on one of said drawer rail and said mounting rail via said mounting plate so that said linear fluid damper dampens movement of said drawer rail; and wherein said holding jaws extend from longitudinal edges of said trough-shaped section and are shaped such that an inner surface of said trough-shaped section with said holding jaws has a uniform radius to allow said cylinder to move axially along said inner surface of said trough-shaped section.

29. The pull-out guide assembly of claim 1, wherein said front plate is fixed to a front end of said trough-shaped section so as to be stationary with respect to said trough-shaped section.

30. A pull-out guide assembly for a drawer, comprising:

a drawer rail to be fitted to the drawer;

a mounting rail to be fitted to a body of furniture; and a damping device including:

a linear fluid damper including a cylinder, a piston, and a piston rod; and a mounting plate having a trough-shaped section for receiving said linear fluid damper therein, and a front plate at an end of said trough-shaped section, said trough-shaped section having a length greater than a length of said cylinder, said trough-shaped section of said mounting plate comprising holding jaws for holding said cylinder of said linear fluid damper therebetween such that said piston rod of said linear fluid damper abuts against said front plate, said holding jaws being arranged to define a bearing for supporting said cylinder so that said cylinder moves axially within said trough-shaped section and through said holding jaws during each damping stroke of a damping operation of said linear fluid damper;

wherein said linear fluid damper is mounted on one of said drawer rail and said mounting rail via said mounting plate so that said linear fluid damper dampens movement of said drawer rail; and wherein said front plate is fixed to a front end of said trough-shaped section so as to be stationary with respect to said trough-shaped section.

* * * * *